US008001872B2

(12) United States Patent
Gorrie

(10) Patent No.: US 8,001,872 B2
(45) Date of Patent: Aug. 23, 2011

(54) JAR OPENER AND METHOD FOR LOOSENING JAR LIDS SUITABLE FOR ARTHRITIC PERSONS

(76) Inventor: Andrew G. Gorrie, Gilbert, AZ (US)

( * ) Notice: Subject to any disclaimer, the term of this patent is extended or adjusted under 35 U.S.C. 154(b) by 252 days.

(21) Appl. No.: 12/486,115

(22) Filed: Jun. 17, 2009

(65) Prior Publication Data

US 2010/0319493 A1 Dec. 23, 2010

(51) Int. Cl.
*B67B 7/18* (2006.01)
*B25B 9/00* (2006.01)
*B25B 1/20* (2006.01)

(52) U.S. Cl. ..... 81/3.4; 81/3.09; 81/3.44; 269/3; 269/6; 269/95

(58) Field of Classification Search ..... 81/3.07, 81/3.4, 3.44, 3.55, 300, 318, 324, 332, 334, 81/335; 29/268, 270; 269/3, 6, 95
See application file for complete search history.

(56) References Cited

U.S. PATENT DOCUMENTS 460,438 A * 9/1891 Haunty ..... 7/127
522,471 A * 7/1894 Kohler ..... 7/129
998,248 A * 7/1911 Berthold ..... 269/161
1,107,684 A * 8/1914 Livingston ..... 140/121
1,364,448 A * 1/1921 Morris ..... 81/3.4
1,473,880 A * 11/1923 Schwager ..... 269/258
1,919,708 A * 7/1933 Adams ..... 81/3.4
2,409,627 A * 10/1946 Helgeson ..... 81/321
2,454,309 A * 11/1948 Davis ..... 81/13
2,614,894 A * 10/1952 Brock ..... 403/40
2,651,226 A * 9/1953 Hopmann ..... 81/3.09
2,654,280 A * 10/1953 Hudnall ..... 81/335
3,229,553 A * 1/1966 Fredrickson ..... 81/3.44
D208,321 S * 8/1967 Brown ..... D8/40
4,050,464 A * 9/1977 Hall ..... 606/86 A
4,179,954 A * 12/1979 Whalen ..... 81/3.44
6,263,761 B1 * 7/2001 Ryder ..... 81/3.09
7,069,815 B1 * 7/2006 Yu ..... 81/3.4
7,204,172 B2 * 4/2007 Stewart ..... 81/3.4

* cited by examiner

*Primary Examiner* — David B Thomas
(74) *Attorney, Agent, or Firm* — Schwegman, Lundberg & Woessner, P.A.

(57) ABSTRACT

Embodiments of an improved jar opener and method for loosening jar lids particularly suitable for persons with arthritic hands are generally described herein. The jar opener includes first and second leveraging elements coupled by a threaded rod and a dual-axis hinge assembly. The jar opener includes curved cut-out regions of different curvatures and the dual-axis hinge assembly includes selectable pivot points to accept jar lids of various diameters.

20 Claims, 3 Drawing Sheets

JAR OPENER AND METHOD FOR LOOSENING JAR LIDS SUITABLE FOR ARTHRITIC PERSONS

TECHNICAL FIELD

Embodiments of the present invention pertain to jar openers and methods for loosening jar lids.

BACKGROUND

Many persons have difficulty loosening jar lids, particularly elderly persons because of reduced strength and persons with arthritic hands. It can be difficult for such persons to grip the lid of a jar with sufficient strength while turning the lid. Thus, there are general needs for improved jar openers and methods for loosening jar lids that are particularly suited for elderly persons and persons with arthritic hands.

DETAILED DESCRIPTION

The following description and the drawings sufficiently illustrate specific embodiments to enable those skilled in the art to practice them. Other embodiments may incorporate structural, logical, electrical, process, and other changes. Examples merely typify possible variations. Portions and features of some embodiments may be included in, or substituted for, those of other embodiments. Embodiments set forth in the claims encompass all available equivalents of those claims.

Figure 1:
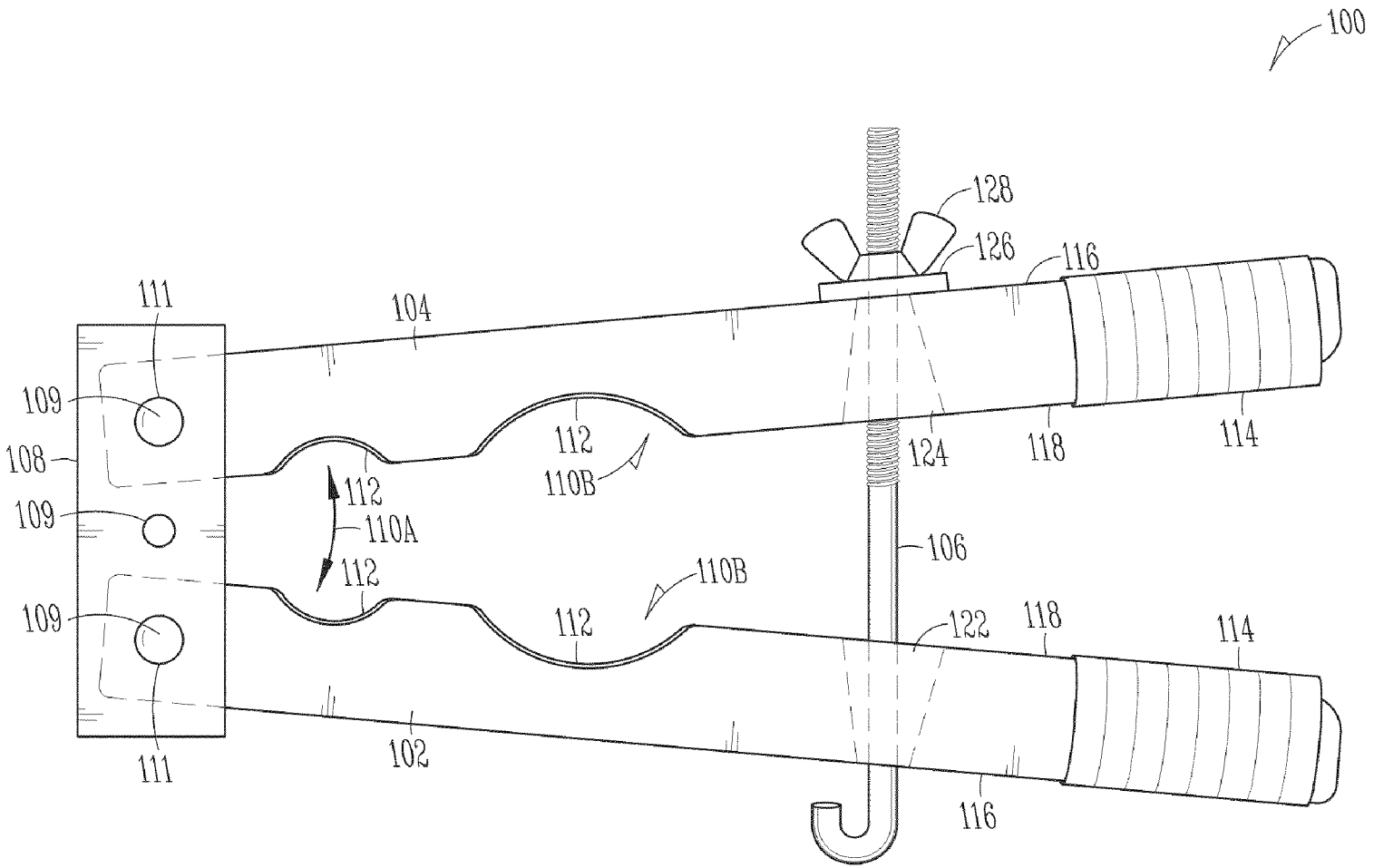
FIG. 1 is a top view of a jar opener in accordance with some embodiments.

FIG. 1 is a top view of a jar opener in accordance with some embodiments. Jar opener 100 is configured for loosening a jar lid using human force and includes first and second leveraging elements 102 and 104, a threaded rod 106 coupling the leveraging elements 102 and 104 and a dual-axis hinge assembly 108. The leveraging elements 102 and 104 have a handle end 114 and the dual-axis hinge assembly 108 couples the first and second leveraging elements 102 and 104 opposite the handle end 114.

The first and second leveraging elements 102 and 104 have at least two sets of oppositely positioned curved cut-out regions 110A and 110B located between the threaded rod 106 and the dual-axis hinge assembly 108. The two sets of oppositely positioned curved cut-out regions 110A and 110B accept jar lids of different sizes. Threaded rod 106 is at least partially threaded and is provided through elongated holes 122 and 124 in the first and second leveraging elements 102 and 104. The elongated holes 122 and 124 are located between the curved cut-out regions 110A and 110B and the handle ends 114 of the first and second leveraging elements 102 and 104.

As illustrated in FIG. 1, both the elongated holes 122 and 124 have a greater elongation toward the insides 118 of the first and second leveraging elements 102 and 104 and have a lesser elongation toward the outsides 116 of the first and second leveraging elements 102 and 104. The greater elongation on the insides 118 of the first and second leveraging elements 102 and 104 may allow for the threaded rod 106 to pass through both the first and second leveraging elements 102 and 104 as the first and second leveraging elements 102 and 104 are separated to accept jar lids of different sizes.

The first and second leveraging elements 102 and 104 have a length selected to provide sufficient leverage to rotate a jar lid when the jar lid is tight. To loosen a jar lid, one hand may be placed on one of the leveraging elements and another hand may be placed on the jar. The leveraging element may be rotated counterclockwise with respect to the jar. Once the jar lid is loosened, the jar lid may easily be removed. The operation of jar opener 100 is described in more detail below.

In the embodiments illustrated in FIG. 1, the first set of the curved cut-out regions 110A that is located closer to the dual-axis hinge assembly 108 has a greater concave curvature for smaller-diameter jar lids. The second set of cut-out regions 110B that is located further from the dual-axis hinge assembly 108 has a lesser concave curvature for larger-diameter jar lids. In these embodiments, either the first set of the second set of the curved cut-out regions is selectable by an operator depending on the size of the jar lid.

The dual-axis hinge assembly 108 includes a connecting member with bolts 111 provided therethrough to provide dual pivot points. In some embodiments, the dual-axis hinge assembly 108 includes three jar-size selection holes 109, which may be arranged in a straight line. Two furthest apart of the jar-size selection holes 109 are selectable for use as pivot points for larger-diameter jar lids. Two closer of the jar-size selection holes 109 are selectable for use as pivot points for smaller-diameter jar lids. As illustrated in FIG. 1, the furthest apart jar-size selection holes have been selected and bolts 111 are illustrated as being provided through the furthest apart jar-size selection holes 109 leaving the center jar-size selection hole 109 open.

In some embodiments, each of the opposite positioned curved cut-out regions 110A and 110B have gripping surfaces 112 comprising a gripping material disposed thereon. The gripping material may comprise a rubber-like or soft plastic material to help prevent slippage on the jar lid during operation. An adhesive may be used to adhere the gripping material to the leveraging elements 102 and 104.

In some embodiments, the threaded rod 106 may have a hooked-end to inhibit passage through the first leveraging element 102. The leveraging elements 102 and 104 may be at least eighteen inches long to provide sufficient leverage. A rubber or plastic washer 126 and a wing nut 128 may be provided on the threaded rod 106 opposite the hooked end. Rotation and tightening of the wing nut 128 may bring the first and second leveraging elements 102 and 104 closer together. In this way, when a jar lid is positioned within one set of the opposite positioned curved cut-out regions (e.g., region 110A) and when the wing nut 128 is tightened, the leveraging elements 102 and 104 are configured to tightly squeeze the jar lid to allow the leveraging elements to be rotated by human force to loosen the jar lid from a jar without slippage of the jar lid. Accordingly, an elderly person or a person with arthritic hands does not need to have the strength to grip the lid of a jar, but simply needs to rotate one of the leveraging elements. The rubber or plastic washer 126 may help to prevent the wing nut 128 from loosening during use.

Figure 2:
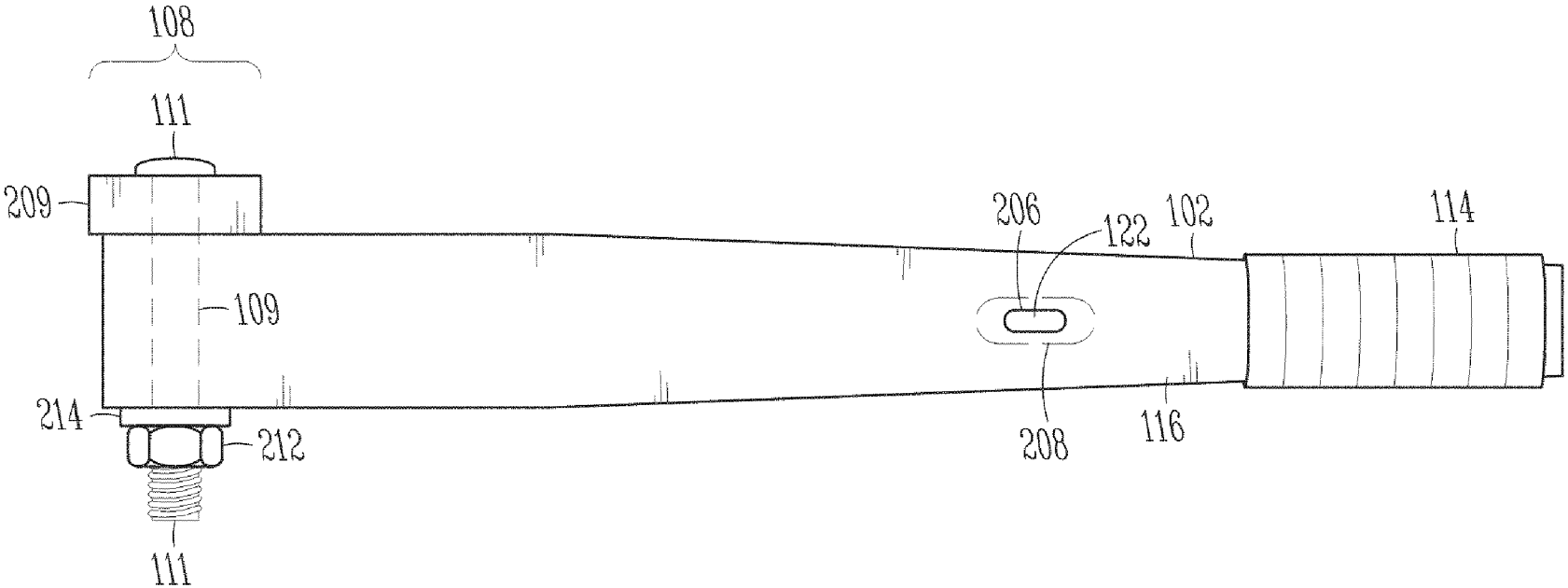
FIG. 2 is a side view of the jar opener of FIG. 1 in accordance with some embodiments.

FIG. 2 is a side view of the jar opener of FIG. 1 in accordance with some embodiments. The side view of the jar opener illustrated in FIG. 2 shows the outside 116 of first leveraging element 102 and the dual-axis hinge assembly 108. As illustrated in FIG. 2, the elongated hole 122 through the first leveraging element 102 has a greater elongation 208 toward an inside of the first leveraging element 102 and has a lesser elongation 206 toward the outside 116 of the first leveraging element 102. Similarly, for second leveraging element 104 (not illustrated in FIG. 2), elongated hole 124 (FIG. 1) provided through the second leveraging element 104 has a greater elongation toward an inside of the second leveraging element 104 (FIG. 1) and has a lesser elongation toward the outside 116 (FIG. 1) of the second leveraging element 104.

The dual-axis hinge assembly 108 includes a connecting member 209 and bolts 111 to provide for the dual pivot points. The dual-axis hinge assembly 108 also includes metal washers 214 and nuts 212 to retain bolts 111. The elongation of the elongated holes 122 and 124 in conjunction with the dual pivot points allows the threaded rod 106 (FIG. 1) to pass through both the first and the second leveraging elements 102 and 104 when the jar-size selection holes 109 are selected for either the smaller-diameter jar lids or the larger-diameter jar lids.

The selection of the jar-size selection holes 109 on the dual-axis hinge assembly 108 comprises inserting a bolt 111 through each of the selected jar-size selection holes 109 and further inserting each bolt 111 through a hole in each one of the leveraging elements to provide the dual pivot points.

Figure 3:
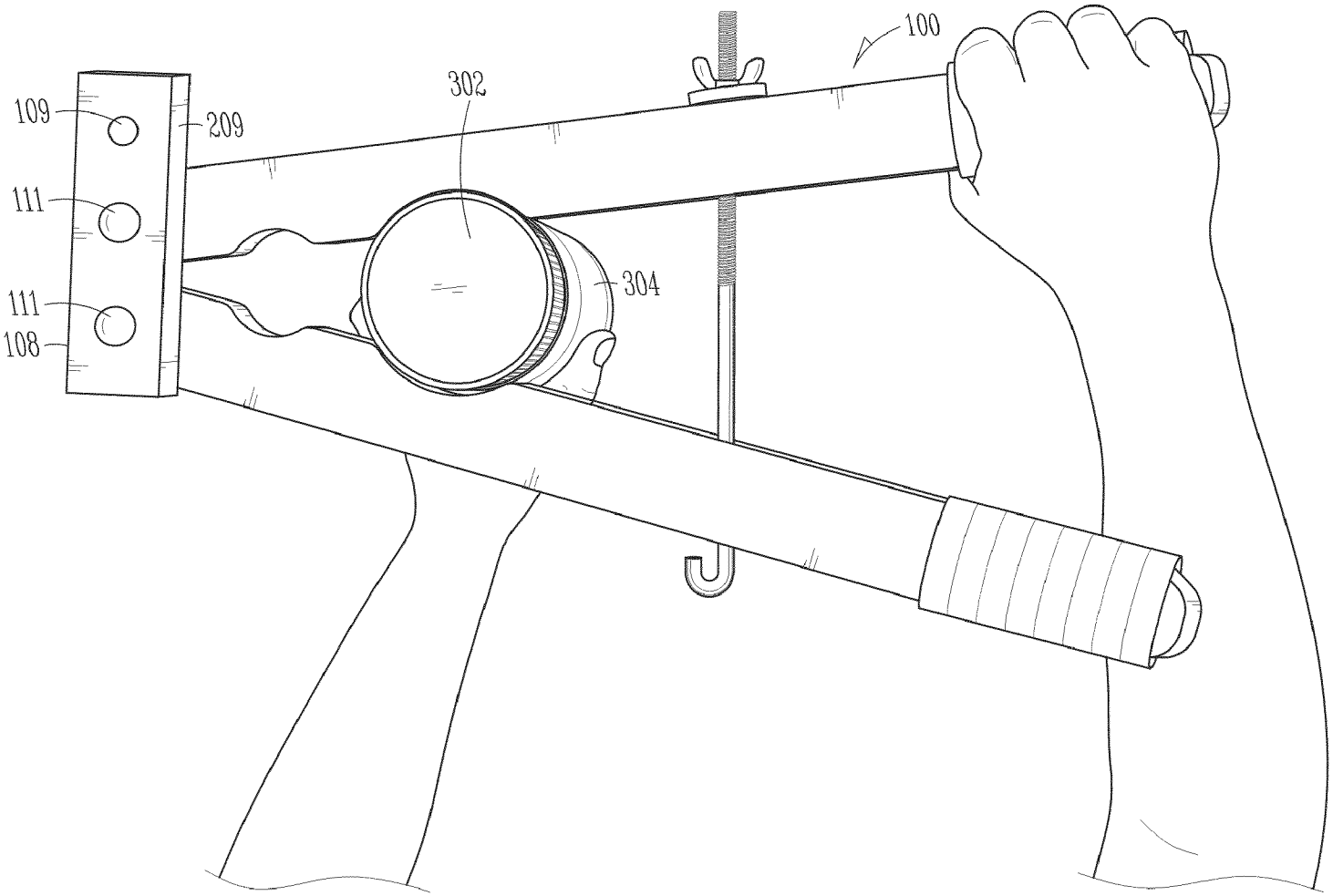
FIG. 3 illustrates the operation of the jar opener of FIG. 1 in accordance with some embodiments.

FIG. 3 illustrates the operation of the jar opener 100 of FIG. 1 in accordance with some embodiments. A lid 302 of a jar 304 is positioned within one set of the opposite positioned curved cut-out regions. The wing nut is tightened and the first and second leveraging elements may tightly squeeze the jar lid 302 to allow the leveraging elements to be rotated by human force to loosen the jar lid 302 from the jar 304 without slippage of the jar lid 302. To loosen the jar lid 302, one hand may be placed on one of the leveraging elements and another hand may be placed on the jar 304 and the leveraging element may be rotated counterclockwise with respect to the jar 304.

In the example illustrated in FIG. 3, the lid 302 is positioned within the opposite positioned curved cut-out region that is further from dual-axis hinge assembly 108. The two closer of the jar-size selection holes 109 have been selected for use as pivot points as having bolts 111 provided therethrough. The combination of the three jar-size selection holes 109 and the two sets of opposite positioned curved cut-out regions 110A and 110B (FIG. 1) provide up to four different configurations to accept jar lids that greatly vary in size. For example, smaller jar lids may be positioned between curved cut-out regions 110A and the two closer jar-size selection holes 109 may be selected. For slightly larger jar lids, curved cut-out regions 110B may be used with the two closer the jar-size selection holes 109. For larger jar lids, curved cut-out regions 110A may be used with the two further apart jar-size selection holes 109. For even larger jar lids, curved cut-out regions 110B may be used with the two further apart jar-size selection holes 109. As can be appreciated, jar opener 100 is suitable for loosening a wide range of sizes of jar lids.

Referring to FIGS. 1 through 3, in some embodiments, a method of loosening a jar lid with a jar opener, such as jar opener 100, is disclosed herein. The method includes positioning the jar lid 302 within one set of the opposite positioned curved cut-out regions (e.g., region 110A), and tightening the wing nut 126 to cause the first and second leveraging elements 102 and 104 to tightly squeeze the jar lid 302. The method also includes rotating one of the leveraging elements by human force to loosen the jar lid 302 from a jar 304 without slippage of the jar lid 302. The method may include placing one hand on only one of the leveraging elements and gripping the jar with another hand while rotating one leveraging element.

In some embodiments, the method of loosening the jar lid may also include selecting a first set of the curved cut-out regions 110A located closer to the dual-axis hinge assembly 108 with a greater concave curvature for smaller-diameter jar lids, or selecting a second of the curved cut-out regions 110B located further from the dual-axis hinge assembly 108 with has a lesser concave curvature for larger-diameter jar lids. In some embodiments, the method of loosening the jar lid may also include selecting two furthest apart of the jar-size selection holes 109 for use as pivot points for larger-diameter jar lids, and selecting two closer of the jar-size selection holes 109 for use as pivot points for smaller-diameter jar lids. Selecting of the jar-size selection holes 109 of the dual-axis hinge assembly 108 may include inserting a bolt 111 through each of the selected jar-size selection holes 109, and inserting each bolt through one of the leveraging elements to provide two pivot points.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A jar opener for loosening a jar lid using human force, the jar opener comprising:

first and second leveraging elements;

a threaded rod coupling the leveraging elements; and a dual-axis hinge assembly coupling the first and second leveraging elements opposite a handle end of the first and second leveraging elements, wherein the first and second leveraging elements have at least two sets of oppositely positioned curved cut-out regions between the rod and the dual-axis hinge assembly to accept jar lids of different sizes, wherein the threaded rod is at least partially threaded and is provided through elongated holes in the first and second leveraging elements to couple the first and second leveraging elements, wherein the elongated holes are located between the curved cut-out regions and the handle ends of the first and second leveraging elements, wherein both the elongated holes have a greater elongation toward an inside of the first and second leveraging elements and have a lesser elongation toward an outside of the first and second leveraging elements, and wherein the greater elongation on the insides of the first and second leveraging elements is to allow for the threaded rod to pass through both the first and second leveraging elements as the first and second leveraging elements are separated to accept jar lids of different sizes.

2. The jar opener of claim 1 wherein the jar opener further comprises a rubber or plastic washer and a wing nut provided on the threaded rod opposite a hooked end, wherein rotation of the wing nut is configured to bring the first and second leveraging elements closer together by tightening, and wherein when a jar lid is positioned within one set of the opposite positioned curved cut-out regions and when the wing nut is tightened, the first and second leveraging elements are configured to tightly squeeze the jar lid to allow the leveraging elements to be rotated by human force to loosen the jar lid from a jar without slippage of the jar lid.

3. The jar opener of claim 2 wherein the first and second leveraging elements have a length to provide leverage to rotate the jar lid when the jar lid is tight.

4. The jar opener of claim 3, wherein to loosen the jar lid, one hand is placed on only one of the leveraging elements and another hand is placed on the jar, the one leveraging element is to be rotated with respect to the jar.

5. The jar opener of claim 4 wherein a first set of the curved cut-out regions is located closer to the dual-axis hinge assembly and has a greater concave curvature for smaller-diameter jar lids, and wherein a second of the curved cut-out regions is located further from the dual-axis hinge assembly and has a lesser concave curvature for larger-diameter jar lids.

6. The jar opener of claim 5 wherein the dual-axis hinge assembly includes three jar-size selection holes arranged in a straight line, wherein two furthest apart of the jar-size selection holes are selectable for use as pivot points for larger-diameter jar lids, and wherein two closer of the jar-size selection holes are selectable for use as pivot points for smaller-diameter jar lids.

7. The jar opener of claim 6 wherein the greater elongation of the elongated holes on the insides of the leveraging elements in conjunction with the pivot points allows the threaded rod to pass through both the first and the second leveraging elements when any two of the jar-size selection holes are selected and when either set of the curved cut out regions is selected.

8. The jar opener of claim 7 wherein selection of the jar-size selection holes of the dual-axis hinge assembly comprises inserting a bolt through each of the selected jar-size selection holes, and further inserting each bolt through one of the leveraging elements to provide two pivot points.

9. The jar opener of claim 8 wherein each of the opposite positioned curved cut-out regions have gripping surfaces comprising a gripping material disposed thereon, and wherein the gripping material comprises a rubber-like or soft plastic material to help prevent slippage on the jar lid during operation.

10. The jar opener of claim 9 wherein the threaded rod has a hooked-end to inhibit passage through the first leveraging element, and wherein the first and second leveraging elements are at least eighteen inches long to provide sufficient leverage.

11. A method of loosening a jar lid with a jar opener comprising first and second leveraging elements, a threaded rod coupling the leveraging elements, and a dual-axis hinge assembly coupling the first and second leveraging elements opposite a handle end of the first and second leveraging elements, wherein the first and second leveraging elements have at least two sets of oppositely positioned curved cut-out regions between the rod and the dual-axis hinge assembly to accept jar lids of different sizes, and wherein the threaded rod is at least partially threaded and is provided through elongated holes in the first and second leveraging elements to couple the first and second leveraging elements, the method comprising:

positioning the jar lid within one set of the opposite positioned curved cut-out regions;

tightening a wing nut on the threaded rod to cause the first and second leveraging elements to tightly squeeze the jar lid; and rotating one of the leveraging elements by human force to loosen the jar lid from a jar without slippage of the jar lid.

12. The method of claim 11 wherein the jar opener further comprises a rubber or plastic washer on the threaded rod opposite a hooked end of the threaded rod, wherein rotation of the wing nut is configured to bring the first and second leveraging elements closer together by tightening, wherein the elongated holes are located between the curved cut-out regions and the handle ends of the first and second leveraging elements, wherein both the elongated holes have a greater elongation toward an inside of the first and second leveraging elements and have a lesser elongation toward an outside of the first and second leveraging elements, and wherein the greater elongation on the inside of the first and second leveraging elements is to allow for the threaded rod to pass through both the first and second leveraging elements as the first and second leveraging elements are separated to accept jar lids of different sizes.

13. The method of claim 12 wherein the first and second leveraging elements have a length to provide leverage to rotate the jar lid when the jar lid is tight.

14. The method of claim 13, wherein to loosen the jar lid, the method includes placing one hand on only one of the leveraging elements and gripping the jar with another hand while rotating the one leveraging element.

15. The method of claim 14 further comprising:

selecting a first set of the curved cut-out regions located closer to the dual-axis hinge assembly with a greater concave curvature for smaller-diameter jar lids; and selecting a second of the curved cut-out regions located further from the dual-axis hinge assembly with has a lesser concave curvature for larger-diameter jar lids.

16. The method of claim 15 wherein the dual-axis hinge assembly includes three jar-size selection holes arranged in a straight line, and wherein the method comprises:

selecting two furthest apart of the jar-size selection holes for use as pivot points for larger-diameter jar lids; and selecting two closer of the jar-size selection holes for use as pivot points for smaller-diameter jar lids.

17. The method of claim 16 wherein the greater elongation of the elongated holes on the insides of the leveraging elements in conjunction with the pivot points allows the threaded rod to pass through both the first and the second leveraging elements when any two of the jar-size selection holes are selected and when either set of the curved cut out regions is selected.

18. The method of claim 17 wherein selecting of the jar-size selection holes of the dual-axis hinge assembly comprises:

inserting a bolt through each of the selected jar-size selection holes; and further inserting each bolt through one of the leveraging elements to provide two pivot points.

19. The method of claim 18 wherein each of the opposite positioned curved cut-out regions have gripping surfaces comprising a gripping material disposed thereon, and wherein the gripping material comprises a rubber-like or soft plastic material to help prevent slippage on the jar lid during operation.

20. An improved jar opener for arthritic persons comprising:

first and second leveraging elements coupled by a threaded rod; and a dual-axis hinge assembly coupling the first and second leveraging elements opposite a handle end of the first and second leveraging elements, wherein the first and second leveraging elements have at least two sets of oppositely positioned curved cut-out regions between the rod and the dual-axis hinge assembly to accept jar lids of different sizes, wherein the threaded rod is at least partially threaded and is provided through elongated holes in the first and second leveraging elements to couple the first and second leveraging elements, wherein the elongated holes are located between the curved cut-out regions and the handle ends of the first and second leveraging elements, wherein both the elongated holes have a greater elongation toward an inside of the first and second leveraging elements and have a lesser elongation toward an outside of the first and second leveraging elements, wherein a first set of the curved cut-out regions is located closer to the dual-axis hinge assembly and has a greater concave curvature for smaller-diameter jar lids, wherein a second of the curved cut-out regions is located further from the dual-axis hinge assembly and has a lesser concave curvature for larger-diameter jar lids wherein the dual-axis hinge assembly includes three jar-size selection holes arranged in a straight line, wherein two furthest apart of the jar-size selection holes are selectable for use as pivot points for larger-diameter jar lids, wherein two closer of the jar-size selection holes are selectable for use as pivot points for smaller-diameter jar lids, wherein the greater elongation of the elongated holes on the insides of the leveraging elements in conjunction with the pivot points allows the threaded rod to pass through both the first and the second leveraging elements when any two of the jar-size selection holes are selected and when either set of the curved cut out regions is selected.

* * * * *